US011060718B2

(12) United States Patent
Alaz

(10) Patent No.: US 11,060,718 B2
(45) Date of Patent: Jul. 13, 2021

(54) FLEXIBLE LANCE FOR MACHINING OR INSPECTING A TUBESHEET OF A BOILER

(71) Applicant: FRAMATOME GMBH, Erlangen (DE)

(72) Inventor: Zafer Alaz, Bubenreuth (DE)

(73) Assignee: FRAMATOME GMBH, Erlangen (DE)

( * ) Notice: Subject to any disclaimer, the term of this patent is extended or adjusted under 35 U.S.C. 154(b) by 309 days.

(21) Appl. No.: 15/771,860

(22) PCT Filed: Oct. 27, 2016

(86) PCT No.: PCT/EP2016/075883

§ 371 (c)(1),
(2) Date: Apr. 27, 2018

(87) PCT Pub. No.: WO2017/072209

PCT Pub. Date: May 4, 2017

(65) Prior Publication Data

US 2018/0347807 A1 Dec. 6, 2018

(30) Foreign Application Priority Data

Oct. 30, 2015 (DE) ..... 10 2015 118 615.2

(51) Int. Cl.
*F22B 37/48* (2006.01)
*F22B 37/00* (2006.01)
(Continued)

(52) U.S. Cl.
CPC ..... *F22B 37/483* (2013.01); *F22B 37/005* (2013.01); *F22B 37/52* (2013.01); *F22B 37/54* (2013.01); *F28G 1/166* (2013.01)

(58) Field of Classification Search
CPC ..... F22B 37/005; F22B 37/83; F22B 37/52; F22B 37/54; F28G 1/166
(Continued)

(56) References Cited

U.S. PATENT DOCUMENTS 4,407,236 A * 10/1983 Schukei ..... F22B 37/483 122/382
5,002,120 A * 3/1991 Boisture ..... B65H 75/4402 122/391
(Continued)

FOREIGN PATENT DOCUMENTS

DE 10 2013 101656 B4 4/2015
EP 0459597 A1 12/1991
(Continued)

*Primary Examiner* — Steven B McCallister
*Assistant Examiner* — Benjamin W Johnson
(74) *Attorney, Agent, or Firm* — Keller Jolley Preece

(57) ABSTRACT

The invention relates to a flexible lance for machining or inspecting a tubesheet of a boiler, having a first strip made of a flexible, metallic material and a second strip made of a flexible, metallic material, wherein the second strip is arranged on the first strip in the longitudinal direction, and wherein at least the second strip has a shaped portion extending in the longitudinal direction for receiving a supply line for a machining or inspection head arranged at the free end of the flexible lance, and wherein the first strip is connected to the second strip such that an open side of the shaped portion is covered by the first strip so as to form a guide channel, and wherein at least one edge region of the flexible lance, extending in the longitudinal direction, is formed only by the first strip or the second strip.

14 Claims, 3 Drawing Sheets

(51) Int. Cl.
*F28G 1/16* (2006.01)
*F22B 37/52* (2006.01)
*F22B 37/54* (2006.01)

(58) Field of Classification Search
USPC ..... 122/392
See application file for complete search history.

(56) References Cited

U.S. PATENT DOCUMENTS 5,022,463 A * 6/1991 Boisture ..... B65H 75/4402 122/379
6,192,904 B1 * 2/2001 Secknus ..... F22B 37/483 122/392
6,877,389 B2 * 4/2005 Lewis ..... B65G 67/24 73/866.5
2009/0211612 A1 8/2009 Athanassiu et al.

FOREIGN PATENT DOCUMENTS

EP 1124092 A2 * 8/2001 ..... F22B 37/483
EP 1124092 B1 4/2009

* cited by examiner

FLEXIBLE LANCE FOR MACHINING OR INSPECTING A TUBESHEET OF A BOILER

CROSS-REFERENCE TO RELATED APPLICATIONS

This application is a national phase entry under 35 U.S.C. § 371 of International Application No. PCT/EP2016/075883, filed Oct. 27, 2016, which claims the benefit of German Application No. 10 2015 118 615.2, filed Oct. 30, 2015. The entire contents of each of the foregoing patent applications are hereby incorporated by reference.

BACKGROUND OF THE INVENTION

1. Technical Field

The invention relates to a flexible lance for machining or inspecting a tubesheet of a boiler, having a first and a second strip which are in each case composed from a flexible, metallic material, and configure a shaped feature, extending in the longitudinal direction, for receiving a supply line for a machining or inspecting head that is disposed at the free end of the flexible lance.

2. Background and Relevant Art

Contaminations which at many locations can have a height of several centimeters are deposited on the tubesheet of a boiler, in particular of nuclear boilers, after a certain operating time. These firmly adhering and very hard contaminations or deposits, respectively, can lead to damage to the boiler tubes that are disposed at a tight spacing. It is therefore necessary to check at regular temporal intervals whether and to what extent such contaminations have formed. The deposits in some instances have to be removed in order to avoid damage.

A flexible lance for machining or inspecting the tubesheet of a boiler, having a first and a second flexible metallic strip, is known from EP 1 124 092 B1. The first and the second strip are superposed so as to be mutually flush and are interconnected, for example, by means of cords which are routed through openings in both strips. Both the first as well as the second strip externally have openings for the engagement of a gear wheel. The incorporation of the openings into the two strips, and the connection of the two strips in such a manner that the openings are disposed so as to lie on top of one another in order to reliably avoid any jamming, is however complex and moreover requires high precision or tight production tolerances, respectively.

SUMMARY

It is therefore an object of the invention to propose a flexible lance which is simple to produce and enables reliable and complete machining or inspecting of a tubesheet of a boiler.

This object is achieved by a flexible lance having the features according to claim 1. Advantageous embodiments and refinements are stated in the respective dependent claims.

The flexible lance for machining or inspecting a tubesheet of a boiler comprises a first strip from a flexible, metallic material, and a second strip from a flexible, metallic material. The second strip in the longitudinal direction is disposed on the first strip. Furthermore, at least the second strip has a shaped feature, extending in the longitudinal direction, for receiving a supply line for a machining or inspecting head that is disposed on the free end of the flexible lance. The first strip is connected to the second strip in such a manner that an open side of the shaped feature formed by the second strip is covered by the first strip so as to form a guide duct.

At least a peripheral region, extending in the longitudinal direction, of the flexible lance is formed only by the first strip or the second strip. In other words, in the peripheral region, or in both peripheral regions running externally in the longitudinal direction, respectively, of the flexible lance one of the two strips is exclusively present, that is to say that the first and the second strip have dissimilar widths.

The advantages of the invention lie in particular in that material is saved by virtue of the smaller size of the first or of the second strip which does not configure the peripheral region. Furthermore, the flexural strength, the stability, and the flexibility of the flexible lance can be influenced in a simple manner in terms of construction solely on account of the variation of the width of the strips and thus of the size of the peripheral region.

A further advantage of the invention lies in that supply lines which are required for the operation of the machining or inspection head, such as a water or power supply, or optical glass fibers for illuminating the location to be cleaned or machined, are protected from damage within the guide duct, and moreover any uncontrolled buckling of the supply lines is largely avoided.

In principle, both strips can have a shaped feature for receiving supply lines. However, the first strip is preferably configured so as to be largely planar and thus has two smooth, mutually opposite flat sides. The shaped feature is thus only formed by the second strip, on account of which the production is further simplified since only one strip has to be molded. The peripheral region in this instance is preferably formed only by the first strip which is configured so as to be largely planar.

The second strip in the longitudinal direction is preferably disposed on the first strip so as to be symmetrical about a central longitudinal axis of the first strip, on account of which the stability of the flexible lance is increased. Should the second strip per se likewise have a symmetrical design embodiment, the shaped feature is thus configured so as to be centric or central, respectively, in the longitudinal direction such that the guide duct is also disposed in a central manner about a central longitudinal axis of the first strip, or of the flexible lance, respectively. On account thereof, mechanical stress on the supply lines, for example in the case of any lateral buckling of the lance, is minimized.

In the case of one advantageous design embodiment, openings for engaging an advancing installation, or of a gear wheel of such an advancing installation, respectively, are disposed in the longitudinal direction in the peripheral region of the flexible lance. The openings herein are disposed at a mutual identical spacing, or so as to be equidistant in a row, thus sequential in the longitudinal direction. The openings are disposed in the peripheral region and thus only present in the first or the second strip. This has the advantage that in the production of the flexible lance no attention has to be paid to the first and the second strip being connected such that the openings are congruent so as to avoid any jamming of the advancing installation during the movement of the machining or inspecting head. Moreover, larger production tolerances are permitted herein, since there are not a plurality of openings that in terms of the extent thereof have to be adapted to one another. Furthermore, time and effort is saved, since openings have to be incorporated only in one strip, this being performed, for example, by means of laser cutting. Should the peripheral region be formed by the first strip which is configured so as to be largely planar, the openings for the gear wheel drive can be accurately made in a simple manner.

The first and the second strip are interconnected at connection locations. This can be performed by rivets, screws, or similar mechanical connection elements. However, the connection at the connection locations is performed in particular by means of spot welding, this requiring fewer production steps and compromising the material only slightly in the environment of the connection locations.

In the case of one preferred design embodiment, at least the second strip has clearances which are disposed sequentially in the longitudinal direction and extend perpendicularly to the longitudinal direction, or in the transverse direction, respectively, of the flexible lance. The clearances herein extend in particular at least partially beyond the shaped feature. The clearances are preferably configured as slots. The second strip is integral, and the shaped features are generated by laser cutting, for example. The first strip can likewise have clearances, for example in the region that covers the guide duct. On account of these clearances it is guaranteed that the second and optionally also the first strip, and thus the flexible lance, are not rendered impermissibly rigid for some applications. A minimum curvature radius of the flexible lance can be set by the choice of the width of the clearances in the longitudinal direction as well as in the transverse direction, and of the mutual spacing of said clearances in the longitudinal direction. The minimum curvature radius is to be understood to be the radius in which further bending of the lance is significantly impeded, further lateral buckling thus being largely suppressed. On account thereof, a lasting deformation and any rupturing of the supply lines that are disposed in the guide duct is reliably avoided.

In one advantageous refinement, part of the clearances is configured as first clearances which in each case extend on both sides and completely beyond the shaped feature, and terminate at a spacing short of the periphery of the second strip.

In the case of a further preferred design embodiment, part of the clearances is configured as second clearances which in each case extend from a periphery of the second strip toward the shaped feature. In each case two second clearances herein are mutually opposite in pairs, thus in relation to the transverse direction of the flexible lance are disposed along a line or parallel to the latter, respectively.

In principle, it is conceivable that the strip has only one of the two forms of clearances, or that the latter are sequential in an arbitrary order. However, the first and the second clearances in an alternating manner are preferably in each case sequential in the longitudinal direction. The flexibility of the lance is further improved on account thereof.

A peripheral portion of the second strip that is in each case disposed between two second clearances preferably has a rounded shape. The connection locations where the first and the second strip are welded to one another are, for example, in this rounded peripheral portion. Round peripheral portions can be more readily generated if the second strip is formed by means of laser cutting. Furthermore, round peripheral portions or edges, respectively, have an advantageous distribution of force and better friction properties.

In order to be able to further influence the mobility of the flexible lance, the first and the second strip preferably have dissimilar flexural strengths. For example, spring steel is used as the material for the flexible lance, or for the first and the second strip, respectively. The flexural strength of the first and of the second strip is varied in a simple manner in terms of construction in that the first and the second strip have dissimilar thicknesses.

BRIEF DESCRIPTION OF THE DRAWINGS

The invention, also in terms of further features and advantages, will be explained in more detail hereunder by means of the description of exemplary embodiments and with reference to the appended drawings. In each case in a schematic diagram.

DETAILED DESCRIPTION

Figure 1:
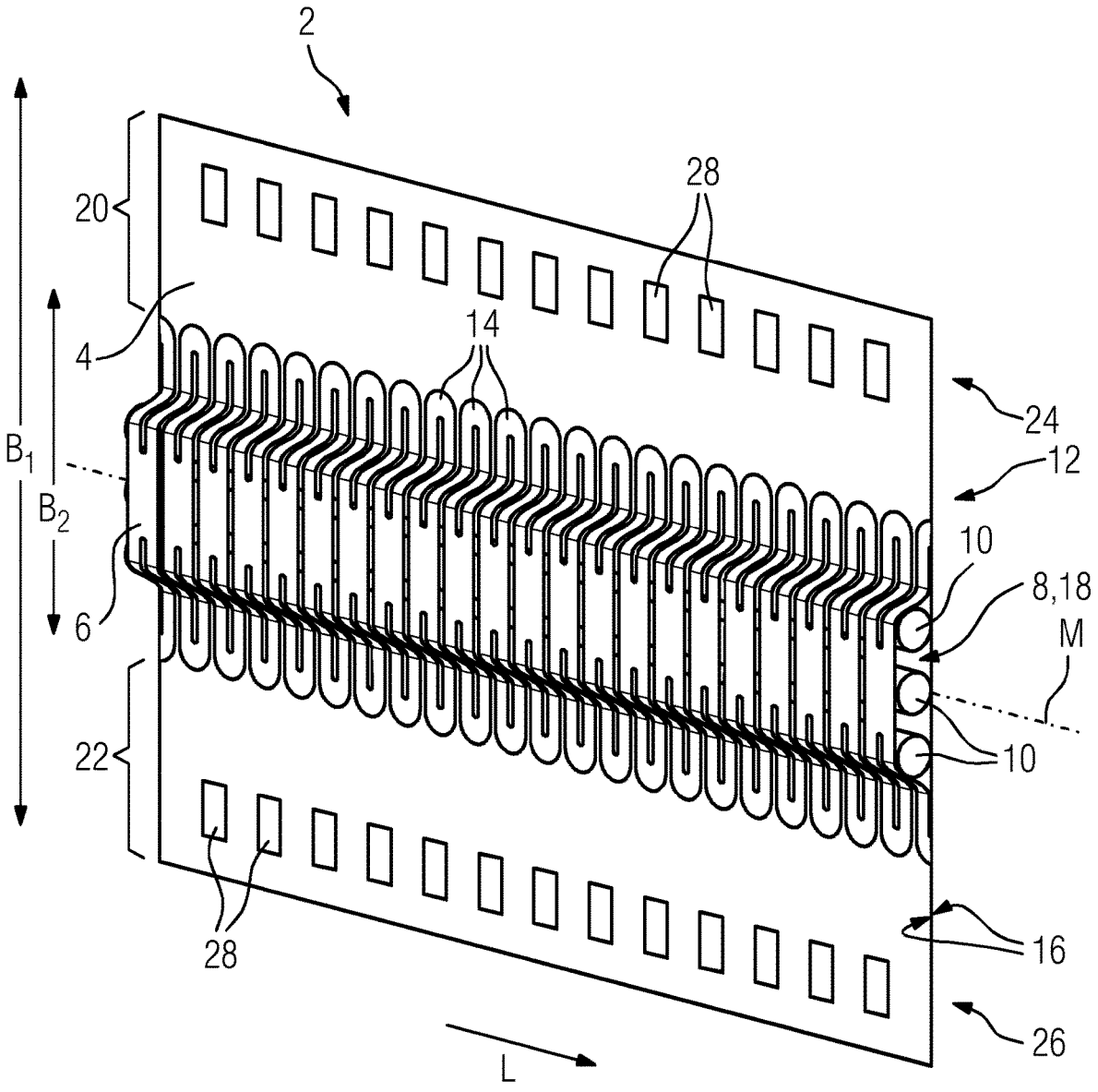
FIG. 1 shows a fragment of a flexible lance in a perspective illustration.

FIG. 1 shows a flexible lance 2 for machining or inspecting a tubesheet of a boiler. The flexible lance 2 is assembled from a flexible, metallic first strip 4, and from a flexible, metallic second strip 6. The two strips 4, 6 are composed of spring steel, for example chromium nickel steel, and have a thickness, or wall thickness, respectively, of approximately 0.1 to 0.3 mm. The width $B_1$ of the first strip 4 is approximately 40 mm, the width $B_2$ of the second strip 6 being approximately 24 mm. The second strip 6 thus has a smaller width than the first strip 4. The second strip 6 in the longitudinal direction L is disposed on the first strip 4 and has a shaped feature 8, or a receptacle for receiving three supply lines 10, respectively, that extends in the longitudinal direction L, said supply lines 10 being connected to a machining or inspecting head (not illustrated in FIG. 1 for reasons of clarity) that is disposed on the free end 12 of the flexible lance 2. The shaped feature 8 has a profile that in the cross-section is U-shaped, and is elongate in the longitudinal direction L of the lance.

The first strip 4 and the second strip 6 have mutually dissimilar flexural strengths. To this end, the first and the second strip 4, 6 can be of dissimilar thicknesses.

Figure 3:
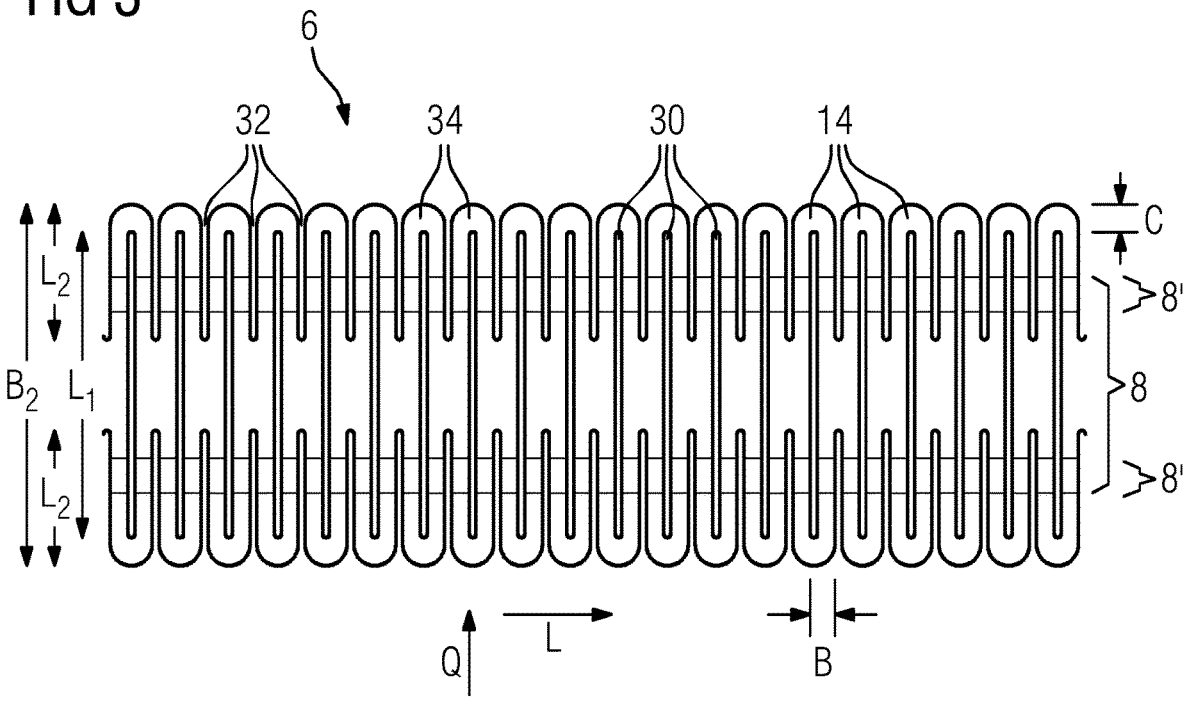
FIG. 3 shows a longitudinal view of the second strip of the flexible lance from FIG. 1, prior to said flexible lance being connected, in a longitudinal view.

The first strip 4 and the second strip 6 are interconnected by spot welding at connection locations 14 which lie in a peripheral portion 34 of the second strip 6 (cf. FIG. 3). The first strip 4 has two mutually opposite flat sides 16. The shaped feature 8 present in the second strip 6 and a flat side 16 of the first strip 4 that faces the second strip 6 therebetween configure a guide duct 18 in which the supply lines 10 are guided. An open side of the shaped feature 8 herein is covered by the first strip 4 such that the guide duct 18 is closed toward all sides, the supply lines 10 thus being protected from damage. The guide duct 18, like the shaped feature 8, extends in the longitudinal direction L of the flexible lance 2.

Since the second strip 6 is of a lesser thickness than the first strip 4, in the case of a centric, or symmetrical, respectively, disposal of the second strip 6 about a central longitudinal axis M of the first strip 4, peripheral regions 20, 22 of the flexible lance 2 that extend in the longitudinal direction are formed only by the first strip 4. Openings 28 for engaging an advancing installation (not explicitly illustrated) are present in the peripheral regions 20, 22

Figure 2:
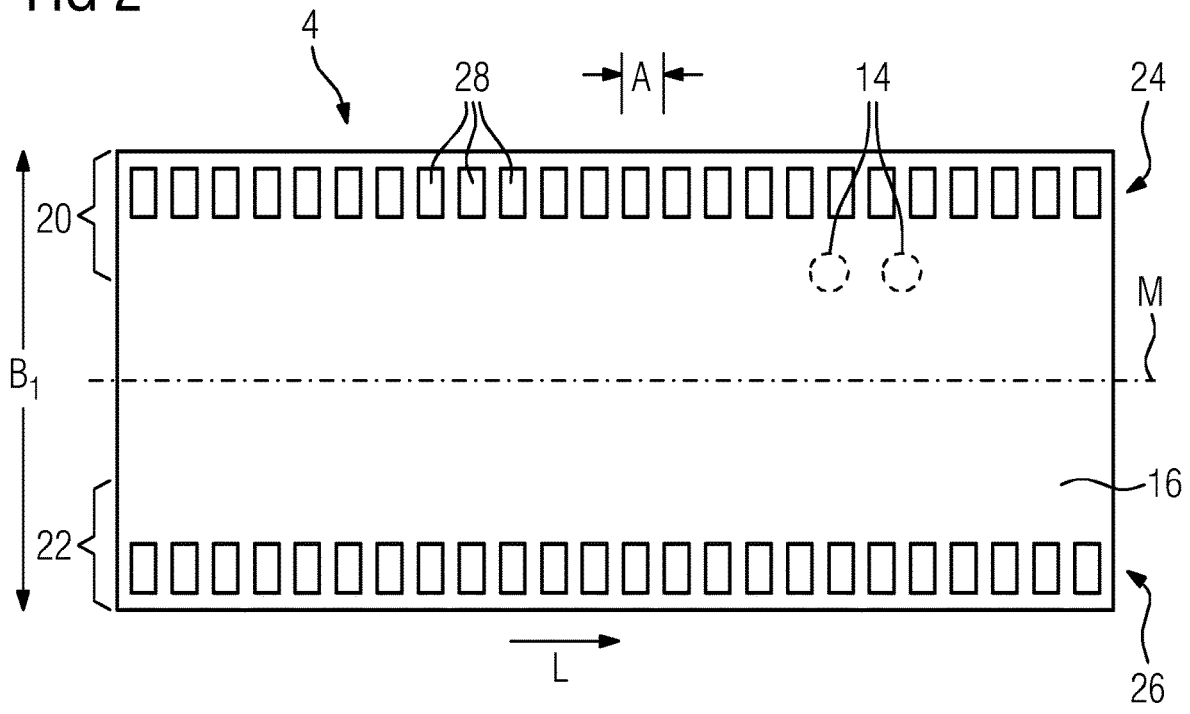
FIG. 2 shows a longitudinal view of the first strip of the flexible lance from FIG. 1, prior to said flexible lance being connected, in a longitudinal view.

FIG. 2 shows a fragment of a longitudinal view of the first strip 4 of the flexible lance 2 from FIG. 1 prior to the latter being connected, in a longitudinal view. The connection locations 14 are indicated by dashed lines. The flexible lance 2, or the first strip 4, respectively, in the two peripheral regions 20, 22, thus externally, has in each case one row 24, 26 of openings 28 which in the longitudinal direction are disposed sequentially and at an equidistant mutual spacing A. The width of the openings 28 is approximately 2 mm, the length being approximately 2.5 mm. The openings 28 in the longitudinal direction have in each case a mutual spacing A of approximately 5 mm. On account of only the first strip 4 having to have the openings 28 required for advancing, the production is simplified and jamming of the lance 2 with the gear wheels of the advancing installation is reliably prevented in particular in the case of small curvature radii.

A fragment of a longitudinal view of the second strip 6 of the flexible lance 2 from FIG. 1 is illustrated in FIG. 3 in a longitudinal view, prior to said second strip 6 being connected to the first strip 4. The second strip 6 has a shaped feature 8 that in the case of the completed lance 2 is U-shaped, wherein the regions 8' configure the legs of the shaped feature. The second strip 6 has clearances 30, 32 which are disposed sequentially in the longitudinal direction L and which extend perpendicularly to the longitudinal direction L, thus in a transverse direction Q, and so as to be mutually parallel. The clearances 30, 32 in part extend beyond the shaped feature 8, thus are present in a region of the shaped feature 8, or of the guide duct 18 that in part is formed by the shaped feature 8. In other words, the second strip 6, or the shaped feature 8, respectively, is interrupted by clearances which in the present case are slot-shaped. On account thereof, it is avoided that the flexible lance 2 as a result of the shaped feature 8 is rendered too rigid for some applications, curving of the flexible lance 2 up to a curvature radius that is capable of being set by way of the size of the clearances 30, 32, or slots, respectively, being possible. The clearances are typically a few tenths of a centimeter wide and laser cut, and the mutual spacing B of the clearances 30, 32 in the longitudinal direction L is approximately 1 mm.

According to FIG. 3, the second strip 6 has two dissimilarly shaped clearances 30, 32. A first shape of the clearances, hereunder the first clearances 30, is in each case designed so as to be slot-shaped, and extends on both sides and completely beyond the shaped feature 8. The first clearances 30 terminate in each case at a spacing C short of the periphery of the second strip 6. The first shaped features 30 have a length $L_1$ of approximately 20 mm.

A second shape of the clearances, hereunder referred to as the second clearances 32, extends in each case from a periphery of the second strip 6 to the shaped feature 8 and in part beyond the latter. The second shaped features 32 are likewise slot-shaped and have a length L2 of approximately 10 mm. A peripheral portion 34 of the second strip 6 that is in each case disposed between two second clearances 32 that are adjacent in the longitudinal direction L has a rounded shape.

The first clearances 30 and the second clearances 32 are sequential so as to respectively alternate in the longitudinal direction L, thus being disposed in an alternating order.

Figure 4:
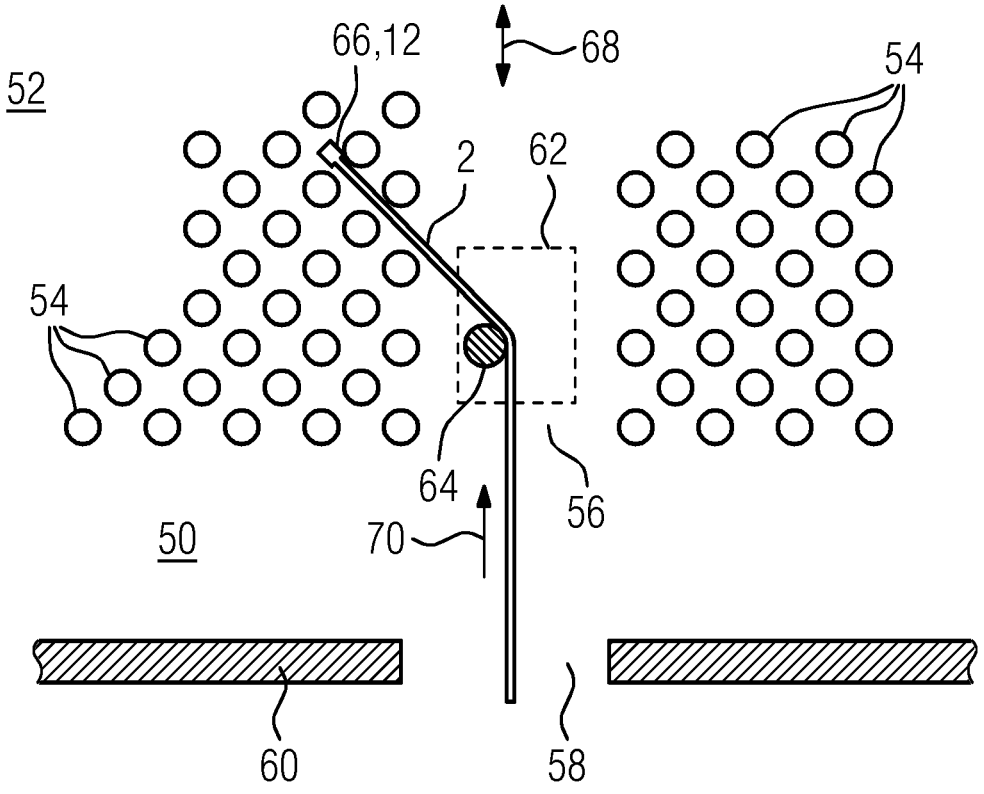
FIG. 4 shows a schematic illustration of the flexible lance being employed during the machining or inspecting of a tubesheet of a boiler.

The use of the flexible lance 2 for machining or inspecting a tubesheet 50 of a boiler 52 is shown in FIG. 4, wherein only a fragment of the boiler 52 is illustrated, the tubes 54 thereof being illustrated in the cross section. The tubes 54 are disposed on both sides of a tube passage 56 which is accessible from the outside by way of an inspection port 58 in a wall 60 of the boiler 52. A manipulator 62 which in FIG. 4 is indicated only in a schematic manner is introduced into the tube passage 56 and is movable in a reciprocating manner in the direction 58. The manipulator 62 comprises a drive roller 64 by way of which the flexible lance 2 is introduced between the tubes 54. A machining or inspecting head 66 is disposed at the free end 12 of the flexible lance 2. With the aid of the manipulator 62, or of the drive roller 64, respectively, the machining or inspecting head 66 is guided between the tubes 54 to the position to be checked or machined by moving the flexible lance 2 in the direction 70. The flexible lance 2 can be deflected to both sides for machining and inspecting, wherein it is however advantageous for the first strip 4 when deflected to be on the inside, to have two flat sides 16 and thus is largely planar.

List of reference signs

| | | | |
|---|---|---|---|
| 2 | Flexible lance | 64 | Drive roller |
| 4 | First strip | 66 | Machining or inspecting head |
| 6 | Second strip | | |
| 8 | Shaped feature | 68 | Direction |
| 10 | Supply line | 70 | Direction |
| 12 | Free end of the flexible lance | $B_1$ | Width of the first strip |
| 14 | Connection locations | $B_2$ | Width of the second strip |
| 16 | Flat side of the first strip | $L_1$ | Length of first shaped feature |
| 18 | Guide duct | $L_2$ | Length of second shaped feature |
| 20, 22 | Peripheral region | | |
| 24, 26 | Row | L | Longitudinal direction |
| 28 | Opening | A | Spacing of openings 28 |
| 30, 32 | Clearance | B | Spacing of peripheral portion 34 |
| 34 | Peripheral portion | C | Spacing of clearances 30, 32 |
| 50 | Tubesheet | | |
| 52 | Boiler | M | Central longitudinal axis |
| 54 | Tube | | |
| 56 | Tube passage | | |
| 58 | Inspection port | | |
| 60 | Wall | | |
| 62 | Manipulator | | |

The invention claimed is:

1. A flexible lance for machining or inspecting a tubesheet of a boiler, having a first strip comprised of a flexible, metallic material, and a second strip comprised of the flexible, metallic material, wherein the second strip in a longitudinal direction is disposed on the first strip, and wherein at least the second strip is formed so as to comprise a recess, extending in the longitudinal direction, for receiving a supply line for a machining or inspecting head that is disposed on a free end of the flexible lance, and wherein the first strip is connected to the second strip in such a manner that an open side of the recess is covered by the first strip so as to form a guide duct, and wherein at least a peripheral region of the flexible lance, extending in the longitudinal direction, is formed only by the first strip or the second strip, and wherein the first strip and the second strip have dissimilar widths, a width being defined perpendicularly to the longitudinal direction.

2. The flexible lance as claimed in claim 1, wherein the first strip has two mutually opposite flat sides.

3. The flexible lance as claimed in claim 1, wherein the second strip in the longitudinal direction is disposed on the first strip so as to be symmetrical about a central longitudinal axis of the first strip.

4. The flexible lance as claimed in claim 1, further comprising openings disposed in the longitudinal direction in the peripheral region of said flexible lance.

5. The flexible lance as claimed in claim 1, wherein the first strip and the second strip are connected one to another by spot welding at connection locations.

6. The flexible lance as claimed in claim 1, wherein at least the second strip has gaps which are disposed sequentially in the longitudinal direction and extend perpendicularly to the longitudinal direction.

7. The flexible lance as claimed in claim 6, wherein the gaps at least partially extend beyond the recess.

8. The flexible lance as claimed in claim 6, wherein the gaps are configured as slots.

9. The flexible lance as claimed in claim 6, wherein the gaps comprise first gaps which respectively extend on opposite sides of the second strip and completely beyond the recess, and terminate at a spacing short of the periphery of the second strip.

10. The flexible lance as claimed in claim 9, wherein the gaps comprise second gaps which respectively extend from a periphery of the second strip toward the recess.

11. The flexible lance as claimed in claim 10, wherein the first and the second gaps are disposed respectively in an alternating manner in the longitudinal direction.

12. The flexible lance as claimed in claim 10, wherein a peripheral portion of the second strip has a rounded shape and is respectively disposed between two second gaps.

13. The flexible lance as claimed in claim 1, wherein the first strip and the second strip have different flexural strengths.

14. The flexible lance as claimed in claim 1, wherein the first strip and the second strip have different thicknesses.

* * * * *